United States Patent [19]

Wrobel

[11] 4,098,547

[45] Jul. 4, 1978

[54] FAN MOUNTING ARRANGEMENT WITH SNAP-TYPE SOCKET

[75] Inventor: Günter Wrobel, Villingen, Fed. Rep. of Germany

[73] Assignee: Papst-Motoren KG, St. Georgen im Schwarzwald, Fed. Rep. of Germany

[21] Appl. No.: 777,920

[22] Filed: Mar. 15, 1977

[30] Foreign Application Priority Data

Mar. 18, 1976 [CH] Switzerland ..... 003385/76

[51] Int. Cl.[2] ..... H01R 13/54

[52] U.S. Cl. ..... 339/91 R; 339/126 R

[58] Field of Search ..... 339/91 R, 125 R, 126, 339/128

[56] References Cited

U.S. PATENT DOCUMENTS

| | | | |
|---|---|---|---|
| 3,289,145 | 11/1966 | Ruehlemann et al. | 339/91 R X |
| 3,440,592 | 4/1969 | Zelle | 339/125 R X |
| 3,440,594 | 4/1969 | Hopp et al. | 339/125 R X |
| 3,523,269 | 8/1970 | Witer et al. | 339/91 R |
| 3,617,982 | 11/1971 | Hardesty | 339/91 R |

*Primary Examiner*—Gerald A. Dost
*Assistant Examiner*—E. F. Desmond
*Attorney, Agent, or Firm*—Michael J. Striker

[57] ABSTRACT

A socket has a pair of spaced elongated side walls which extend lengthwise along a predetermined direction, and an upper and a lower wall located at respective opposite end regions of the side walls. The socket also includes a connecting wall extending intermediate the side walls and connecting the latter. The connecting wall is formed with a pair of passages which are spaced along the predetermined direction relative to each other by a predetermined distance. These passages are operative for receiving electrical pins connected to electrical motor wires and for mounting such wires at said predetermined distance relative to each other. The socket is insertable into a cutout of the housing and is connected to the latter by a resiliently yieldable element which is mounted on the upper wall of the socket. The socket also comprises a guide member on one of the side walls and a fixing member on the lower wall for respectively guiding and fixing the socket upon its insertion into the cutout of the housing.

14 Claims, 7 Drawing Figures

FAN MOUNTING ARRANGEMENT WITH SNAP-TYPE SOCKET

BACKGROUND OF THE INVENTION

The present invention generally relates to a mounting arrangement and, more particularly, to an arrangement for mounting electrical motor wires in a fan housing. Still more particularly, the invention relates to a fan mounting arrangement which utilizes a snap-type socket.

Fan blower arrangements generally comprise an impeller and an electrical motor for driving the impeller. The electrical voltage and current required for energizing the motor is supplied from an external source, preferably by a line-mounted, female-type electrical connector having at least two electrically-conductive sockets. These two sockets mate with two electrically-conductive prongs which are in turn electrically connected to a pair of wires which conduct the electrical energy to the motor.

It has been proposed in the prior art to position the prongs at a fixed predetermined distance from each other, thereby forming a two-pronged, male-type electrical plug, by mounting the prongs in a socket member or receptacle which is fixedly attached to the fan blower housing. It is known to fixedly secure the socket member either in a recess formed between two housing parts or in a recess formed in a single housing. In both cases, the socket member is secured to the housing with rivets, that is, a rivet is first inserted through juxtaposed portions of the housing and socket member and, thereupon, a deformable end of a rivet is flanged over so as to securely connect the juxtaposed portions.

The known prior-art proposals are disadvantageous in that they are very costly to manufacture because of their multi-part construction. Moreover, the riveting operation is extremely time-consuming and uneconomical.

A further disadvantage exists when one wishes to quickly disconnect the socket member from the housing. In the known constructions, one is compelled to first drill out the rivets prior to disconnection. It will be appreciated that this additional drilling operation makes demounting of the socket member a very laborious process.

SUMMARY OF THE INVENTION

Accordingly, it is the general object of the present invention to overcome the drawbacks of the prior art.

An additional object of the present invention is to eliminate the use of rivets for interconnecting a socket member with a fan blower housing.

A further object of the present invention is to provide snap-type interengagement between the socket member and the fan blower housing so as to facilitate quick and easy mounting and demounting of the socket member relative to the housing.

In keeping with these objects and others which will become apparent hereinafter, one feature of the invention resides, briefly stated, in a combination in a mounting arrangement, particularly an arrangement for mounting electrical motor wires in a fan, which comprises a housing having a cutout portion, and a socket member having an insert portion insertable into the cutout portion in a predetermined direction. Interengaging means are provided on both of these portions for connecting the latter with snap-type action. The interengaging means includes a resiliently yieldable element on one of the portions which is operative for resiliently engaging the other of said portions upon insertion in said predetermined direction, and also for resiliently disengaging from said other portion in direction opposite to said predetermined direction for disconnecting said portions from each other.

In accordance with the invention, the socket member comprises a pair of spaced elongated side walls which extend lengthwise along a predetermined direction, and an upper and a lower wall at respective opposite end regions of the side walls. The socket member further comprises a connecting wall which extends intermediate the side walls and connects the latter. A pair of passages are formed in and extend through the connecting wall and are spaced relative to each other along said predetermined direction by a predetermined distance. These passages respectively receive pins which are connected to the electrical motor wires, and these passages therefore serve to mount the pins and their connected wires at said predetermined distance relative to each other, thereby forming a two-pronged, male-type electrical plug.

The snap-type interengaging means is highly advantageous over the rivet interconnection of the prior-art proposals. The mounting operation is vastly simplified since one need no longer flange deformable ends of rivets. In addition, since the resiliently yieldable element cooperates with a tapered abutment shoulder and bounds a space therewith, a demounting tool will have easy access to the resiliently yieldable element. Thus, the demounting or removal operation is also vastly simplified and improved over the prior-art proposals. One need no longer drill out any rivet connections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
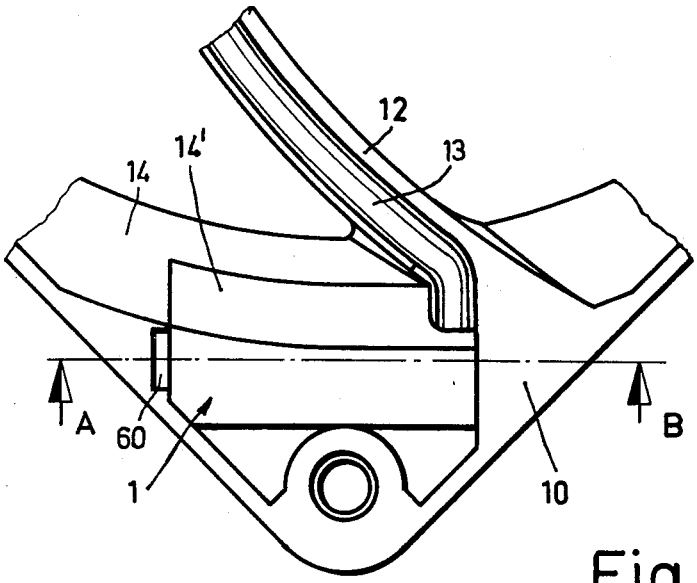
FIG. 1 is a broken-away, top-plan view of a corner region of a fan housing, as viewed in direction of arrow I of FIG. 2.

FIG. 1 illustrates a top plan view of a corner region of a fan or blower assembly, preferably of the axial flow type. The assembly includes a generally guadrilaterally-shaped, one-piece housing 10 which is formed with a plurality of channel-shaped spokes or ribs 12, each of which extends generally in radial direction from the outer periphery of the housing 10 inwardly towards a central hub which journals an impeller shaft. A plurality of blades are mounted on the impeller shaft for rotation therewith, and these impeller parts are driven about the axis of elongation of the impeller shaft by a drive, preferably an electrical motor. The electrical motor, the central hub, and the impeller are entirely conventional and have not been illustrated in the drawings in order not to unduly encumber them.

Figure 2:
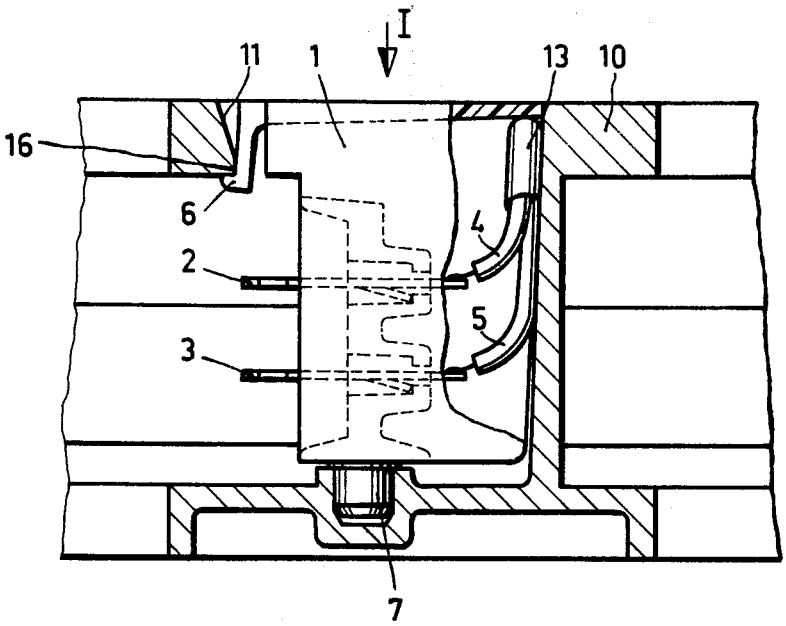
FIG. 2 is a broken-away sectional view taken on line II—II of FIG. 1.

It is sufficient to note that the electrical energy is supplied to the electric motor by electrically-conductive cables or wires 4, 5, as shown in FIG. 2. The wires 4, 5 are surrounded by an electrically-insulating tubular sheath 13, and the wires together with the sheath 13 are received in and extend along a U-shaped channel of a selected spoke 12. The conductor portion of each wire 4, 5 is soldered, welded or otherwise electrically connected to a respective prong or pin 2, 3. The pins 2 and 3 are mounted in a socket member or receptacle 1 at a fixed predetermined distance relative to each other, thereby constituting a two-prong, male-type electrical plug. In order to energize the motor, this plug is connected to a non-illustrated line-mounted, female-type electrical connector.

The socket member 1 is insertable into a cutout portion of a cavity of the housing 10. As shown in FIG. 1, the contour of this cutout portion extends into an inclined surface 14 which bounds a conically-shaped inflow passage. The trailing end portion or upper wall 14' of socket member 1 is of complementary contour to that of the cutout portion.

The arrow I in FIG. 2 shows the direction of insertion of socket member 1 into the cutout portion. The leading end or lower wall of socket member 1 is provided with a guide or fixing pin 7 which extends generally along the insertion direction and which is operative for guiding and for fixing the socket member in a groove of the housing, thereby positioning the socket member in proper position. The trailing end or upper wall 14' of socket member 1 has a resiliently yieldable element having a main resilient portion or finger 60 and a detent portion 6. The resilient portion is operative for resiliently engaging an abutment shoulder 11 and thereby for fixedly securing the socket member in the illustrated engaged position, and also for resiliently disengaging from the abutment shoulder and thereby for disconnecting the socket member from the housing.

The abutment shoulder 11 has a tapered bearing surface facing the resiliently yieldable element. During insertion the detent portion 6 bears against this tapered bearing surface which is operative for urging the detent portion 6 in direction away from the abutment shoulder. Upon full insertion into the cutout, the detent portion 6 clears the edge 16 of abutment shoulder 11 and snaps into engagement behind edge 16, thereby locking the socket portion in the illustrated position with snap-type action. The tapered bearing surface bounds with resilient element 60 a space which provides access for a demounting tool. For disconnecting the socket member, a tool is inserted into this space and is operative for deflecting the detent portion 6 again away from shoulder 11 until the detent portion 6 clears edge 16. Thereupon, the socket member may be easily removed in direction opposite to arrow I. Of course, the roles of the resilient element 6 and of the abutment shoulder 11 can be reversed, i.e. the resilient element could be provided on the housing and the shoulder 11 could be provided on the socket member. It will be noted that the resilient element also has a tapered outer surface which faces the bearing surface of shoulder 11 and which bounds the aforementioned space with the latter so as to facilitate entry of the demounting tool.

Figure 3:
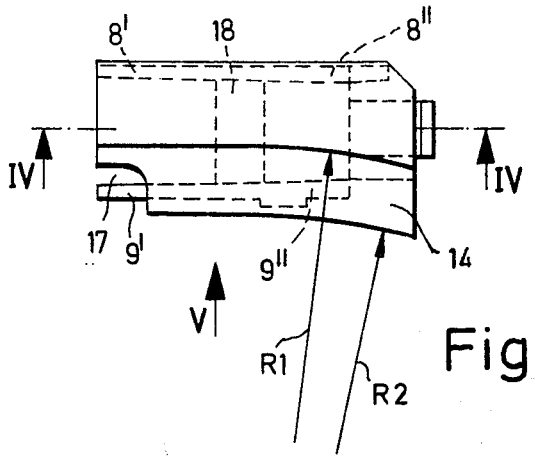
FIG. 3 is a top-plan view of a socket member in accordance with the present invention.

FIG. 3 is a top-plan view of socket member 1 and shows a pair of spaced side walls 8, 9 connected by an intermediate connecting wall 18. The opposite sides of side walls 8 and 9 are respectively identified by reference numerals 8', 8'' and 9', 9''. The upper wall 14' has a tapered outer surface whose opposite edges are located at different radial distances R1 and R2 from the center of the housing. The upper wall 14' is also formed with a slot 17 through which a portion of spoke 12, sheath 13 and wires 3, 4 pass.

Figure 4:
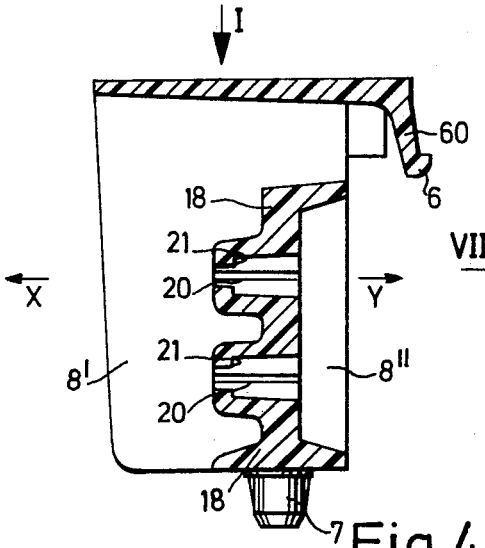
FIG. 4 is a sectional view taken on line IV—IV of FIG. 3.

FIG. 4 is a sectional view taken on line IV—IV of FIG. 3 and illustrates a pair of passages 20 which are formed through the connecting wall 18 and which are operative for receivably mounting the pins 2, 3 at the aforementioned predetermined distance relative to each other. A shoulder 21 is formed in each passage 20, and each shoulder engages with snap-type action a respective resilient offset portion of the pins 2 and 3, as shown in FIG. 2. The connecting wall 18, as well as all other walls of the housing are all integral with each other and form a one-piece socket member, preferably constituted by electrically-insulating synthetic plastic material so as to meet electrical safety requirements.

The connecting wall 18 has wall portions which gradually taper in outward direction, as considered in direction normal to the insertion direction. That is, as considered in either direction of arrow *x* or arrow *y* in FIG. 4, the wall portions gradually and linearly taper outwardly. For example, the wall portions bounding a cavity with side wall portions 8'' diverge outwardly in direction of arrow *y*. Similarly, the wall portions bounding passages 20 also diverge outwardly in direction of arrow *y*. Put another way: no undercuts are formed in connecting wall 18, nor are any undercuts formed in parts 6–9, 14' or 15. The feature of not forming any undercuts in the socket member permits the latter to be advantageously and economically manufactured in a two-part molding arrangement which does not require a pusher.

Figure 5:
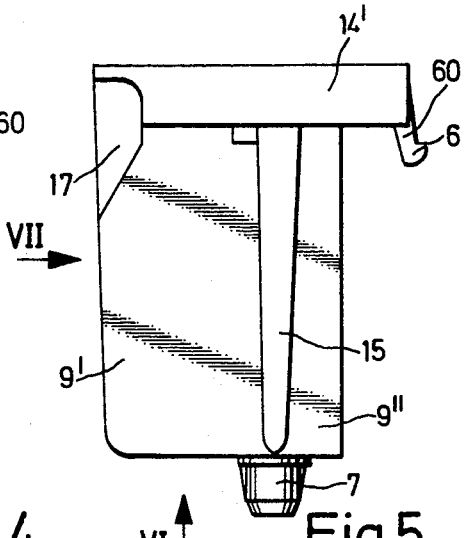
FIG. 5 is a side view of the socket member as viewed in direction of arrow V of FIG. 3.

FIG. 5 shows a guide or fixing projection 15 which like pin 7 extends generally along the insertion direction and which is operative for guiding and for fixing the socket member in a corresponding groove of the housing 10.

Figure 6:
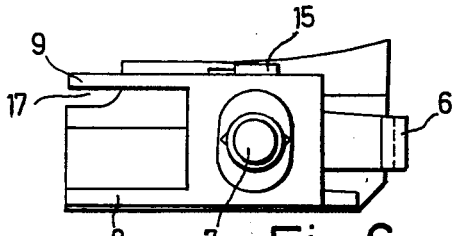
FIG. 6 is a bottom view of a socket member, as viewed in direction of arrow VI of FIG. 5.
Figure 7:
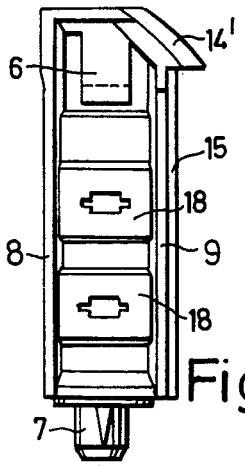
FIG. 7 is a side view of the socket member of FIG. 5, as viewed in direction of arrow VII of FIG. 5.

FIGS. 6 and 7 are respective views showing the lower and side views of FIG. 5 in direction of arrows VI, VII. Like reference numerals have been used throughout these Figures in order to facilitate their comparison with the previously-discussed Figures.

Advantageously, the socket member 1 is constituted by high-temperature-resistant thermoplastic material, e.g. a polycarbonate, which is intermixed with glass fibers. If the cables 4, 5 are soldered to the pins 2, 3 at the housing, the temperature-resistant plastic material will maintain its shape despite the application of heat. In order to make the resiliently yieldable element of sufficient strength and of sufficient elasticity, it is advantageous that the percentage of glass fibers in the polycarbonate material not exceed approximately 10% of the total mixture. In a preferred embodiment, the resiliently yieldable element has a thickness on the order of 1 millimeter and a width on the order of 4 millimeters.

It will be understood that each of the elements described above, or two or more together, may also find a useful application in other types of constructions differing from the types described above.

While the invention has been illustrated and described as embodied in a fan mounting arrangement with snap-type socket, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a mounting arrangement, particularly for mounting electrical motor wires in a fan, a combination comprising a housing having a cutout portion and a channel-shaped rib for receiving electrical motor wires; a socket member having an insert portion insertable into said cutout portion in predetermined direction and being formed with a slot for receiving said rib; and interengaging means on both of said portions for connecting the latter with snap-type action, including a resiliently yieldable element on one of said portions, said element being operative for resiliently engaging the other of said portions upon insertion in said predetermined direction, and also for resiliently disengaging from said other portion in direction opposite to said predetermined direction for disconnecting said portions from each other.

2. The arrangement of claim 1, wherein said interengaging means includes an abutment shoulder on said other portion and in juxtaposed relationship with said resiliently yieldable element.

3. The arrangement of claim 2, wherein said abutment shoulder has a bearing surface on which said resiliently yieldable element bears during insertion for urging said resiliently yieldable element between a disengaged position and an engaged position, said bearing surface being tapered and bounding with said resiliently yieldable element a space for receiving a demounting tool.

4. The arrangement of claim 1, wherein said socket member has a pair of spaced side walls extending along said predetermined direction, and a connecting wall intermediate and connecting said side walls, said connecting wall having a pair of passages spaced a predetermined distance from each other; and further comprising a pair of pins connectable with electrical motor wires and respectively receivable in said passages for mounting said pins relative to each other at said predetermined distance.

5. The arrangement of claim 4, wherein said connecting wall has wall portions which gradually taper in outward direction, as considered in direction normally to said predetermined direction.

6. The arrangement of claim 4; and further comprising means for fixedly securing said pins to electrical motor wires with application of heat, and wherein said socket member is constituted by high heat-resistant, thermoplastic synthetic plastic material.

7. The arrangement of claim 1; and further comprising means for guiding and for fixing said insert portion in said cutout portion, including a guide member on one of said portions and extending generally along said predetermined direction, and a guide groove on the other of said portions and also extending generally along said predetermined direction for receiving said guide member upon insertion.

8. The arrangement of claim 1, wherein said socket member has a leading end portion and a trailing end portion as considered along said predetermined direction, and wherein said socket member has a pair of spaced side walls extending intermediate said leading and trailing end portions.

9. The arrangement of claim 1, wherein said socket member is of one piece construction and is constituted by synthetic plastic material.

10. The arrangement of claim 1, wherein said cutout portion has a predetermined outline, and wherein said socket member has a trailing end portion of complementary contour to said predetermined outline.

11. The arrangement of claim 1, wherein said resiliently yieldable element has wall portions which gradually taper in outward direction, as considered in direction normally to said predetermined direction.

12. The arrangement of claim 1, wherein said socket member is constituted by synthetic plastic material composed of a mixture predominantly containing polycarbonate intermixed with glass fibers, said glass fibers amounting to at most 10% of the content of the mixture.

13. The arrangement of claim 1, wherein said resiliently yieldable element has a main resilient portion and a detent portion, said main resilient portion having a thickness of approximately 1 millimeter and a width of approximately 3.5 millimeters.

14. A socket member for mounting electrical wires in a housing, particularly in a fan housing in which electrical motor wires are to be respectively connected with pins, comprising a pair of elongated side wall surfaces extending lengthwise along a predetermined direction and being spaced from each other in direction transverse to said predetermined direction; an upper and a lower wall surface at respective opposite end regions of said side wall surfaces; a connecting wall on said lower-wall surfaces and extending towards said upper wall surface, said connecting wall also extending intermediate said side wall surfaces and connecting the latter; a resiliently yieldable element on said upper wall surface and operative for resiliently engaging the housing upon insertion of the socket member into the latter, and also for resiliently disengaging from the housing for disconnecting the socket member from the housing; a guide member on at least one of said side wall surfaces, said guide member extending generally along said predetermined direction and being operative for guiding the socket member into the housing; a fixing member on said lower wall surface, said fixing member extending generally along said predetermined direction and being operative for fixing the position of the socket member upon insertion into the housing; and a pair of passages on said connecting wall for respectively receiving the pins connected to the electrical wires, said passages extending through said connecting wall and being spaced along said predetermined direction relative to each other by a predetermined distance for mounting the pins and their connected wires at said predetermined distance relative to each other.

* * * * *